US010775055B2

(12) United States Patent
Bewley, Jr. et al.

(10) Patent No.: US 10,775,055 B2
(45) Date of Patent: Sep. 15, 2020

(54) BULKHEAD ASSEMBLIES FOR AIR CONDITIONER UNITS

(71) Applicant: Haier US Appliance Solutions, Inc., Wilmington, DE (US)

(72) Inventors: Wilbur Carl Bewley, Jr., Nicholasville, KY (US); Robert William Jewell, Aurora, OH (US); James Bryan Rawson, Crestwood, KY (US); Stephen D. Hatcher, Henryville, IN (US); Mike Fradkin, Peachtree City, GA (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 42 days.

(21) Appl. No.: 16/142,053

(22) Filed: Sep. 26, 2018

(65) Prior Publication Data

US 2020/0096209 A1 Mar. 26, 2020

(51) Int. Cl.

| | |
|---|---|
| ***F24F 1/02*** | (2019.01) |
| ***F24F 13/20*** | (2006.01) |
| ***F24F 11/88*** | (2018.01) |
| ***F24F 13/32*** | (2006.01) |
| ***F24F 1/62*** | (2011.01) |

(52) U.S. Cl.

CPC ..... *F24F 1/62* (2013.01); *F24F 13/20* (2013.01); *F24F 13/32* (2013.01)

(58) Field of Classification Search

CPC .... F24F 1/02; F24F 1/022; F24F 13/20; F24F 13/32; F24F 13/224; F24F 2013/207; F24F 11/88; F24F 11/89; F24F 2221/20; F25D 29/005

See application file for complete search history.

(56) References Cited

U.S. PATENT DOCUMENTS

| | | | | |
|---|---|---|---|---|
| 5,248,196 | A * | 9/1993 | Lynn | F25D 23/065 264/276 |
| 5,461,880 | A | 10/1995 | Bolton et al. | |
| 9,518,758 | B2 | 12/2016 | Lee et al. | |
| 2016/0252260 | A1 * | 9/2016 | Jewell | F24F 1/022 62/259.1 |

FOREIGN PATENT DOCUMENTS

| | | | |
|---|---|---|---|
| KR | 20040107732 | A | 12/2004 |

* cited by examiner

*Primary Examiner* — Frantz F Jules
*Assistant Examiner* — Erik Mendoza-Wilkenfel
(74) *Attorney, Agent, or Firm* — Dority & Manning, PA

(57) ABSTRACT

A bulkhead assembly includes bulkhead having a first surface facing a first direction and a second surface facing a second direction. The second surface is opposite the first surface. A first connector is disposed on the bulkhead facing the first direction. A second connector is disposed on the bulkhead facing the second direction.

10 Claims, 5 Drawing Sheets

BULKHEAD ASSEMBLIES FOR AIR CONDITIONER UNITS

FIELD OF THE INVENTION

The present disclosure relates generally to air conditioner units, and more particularly to improved apparatus for accessing connectors associated with bulkheads of air conditioner units.

BACKGROUND OF THE INVENTION

Air conditioner units are conventionally utilized to adjust the temperature within structures such as dwellings and office buildings. In particular, one-unit type room air conditioner units may be utilized to adjust the temperature in, for example, a single room or group of rooms of a structure. A typical such air conditioner unit includes an indoor portion and an outdoor portion. The indoor portion is generally located indoors, and the outdoor portion is generally located outdoors. Accordingly, the air conditioner unit generally extends through a wall, window, etc. of the structure.

In the outdoor portion of a conventional air conditioner unit, a compressor that operates a refrigerating cycle is provided. At the back of the outdoor portion, an outdoor heat exchanger connected to the compressor is disposed, and facing the outdoor heat exchanger, an outdoor fan for cooling the outdoor heat exchanger is provided. At the front of the indoor portion of a conventional air conditioner unit, an air inlet is provided, and above the air inlet, an air outlet is provided. A blower fan and a heating unit are additionally provided in the indoor portion. Between the blower fan and heating unit and the air inlet, an indoor heat exchanger connected to the compressor is provided.

When cooling operation starts, the compressor is driven to operate the refrigerating cycle, with the indoor heat exchanger serving as a cold-side evaporator of the refrigerating cycle, and the outdoor heat exchanger as a hot-side condenser. The outdoor heat exchanger is cooled by the outdoor fan to dissipate heat. As the blower fan is driven, the air inside the room flows through the air inlet into the air passage, and the air has its temperature lowered by heat exchange with the indoor heat exchanger, and is then blown into the room through the air outlet. In this way, the room is cooled.

When heating operation starts, the heating unit is operated to raise the temperature of air in the air passage. The air, having had its temperature raised, is blown out through the air outlet into the room to heat the room.

Further, conventional air conditioner units include a bulkhead which is positioned between the indoor portion and outdoor portion, and thus generally separates the components within the indoor portion from the components in the outdoor portion. Various components may additionally be connected to the bulkhead, such as the blower fan and heating unit. Components which may be connected to the bulkhead include components located in both the indoor portion and the outdoor portion of the air conditioner unit.

One issue with many presently known bulkheads and air conditioner units is the difficulty in accessing connectors positioned on only one side of the bulkhead.

Accordingly, improved apparatus for accessing connectors associated with bulkheads in air conditioner units is desired in the art. In particular, apparatus which facilitate such access during manufacture and/or maintenance of air conditioner units and thus reducing the associated time and labor would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, an air conditioner unit is provided. The air conditioner unit defines a vertical direction, a lateral direction, and a transverse direction. The vertical direction, the lateral direction, and the transverse directions are mutually perpendicular. The air conditioner unit includes at least one outdoor component disposed in an outdoor portion of the air conditioner unit and at least one indoor component disposed in an indoor portion of the air conditioner unit. A bulkhead is disposed between the outdoor portion and the indoor portion along the transverse direction. The bulkhead includes an indoor surface facing the indoor portion of the air conditioner unit and an outdoor surface facing the outdoor portion of the air conditioner unit. At least one indoor connector is disposed on the bulkhead and faces the indoor portion of the air conditioner unit. At least one outdoor connector is disposed on the bulkhead and faces the outdoor portion of the air conditioner unit.

In accordance with another embodiment, a bulkhead assembly of an air conditioner unit is provided. The bulkhead assembly is disposed between an indoor portion of an air conditioner unit and an outdoor portion of the air conditioner unit. The bulkhead assembly includes a bulkhead which includes a first surface facing a first direction and a second surface facing a second direction. The second surface is opposite the first surface. A first connector is disposed on the bulkhead facing the first direction. A second connector is disposed on the bulkhead facing the second direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
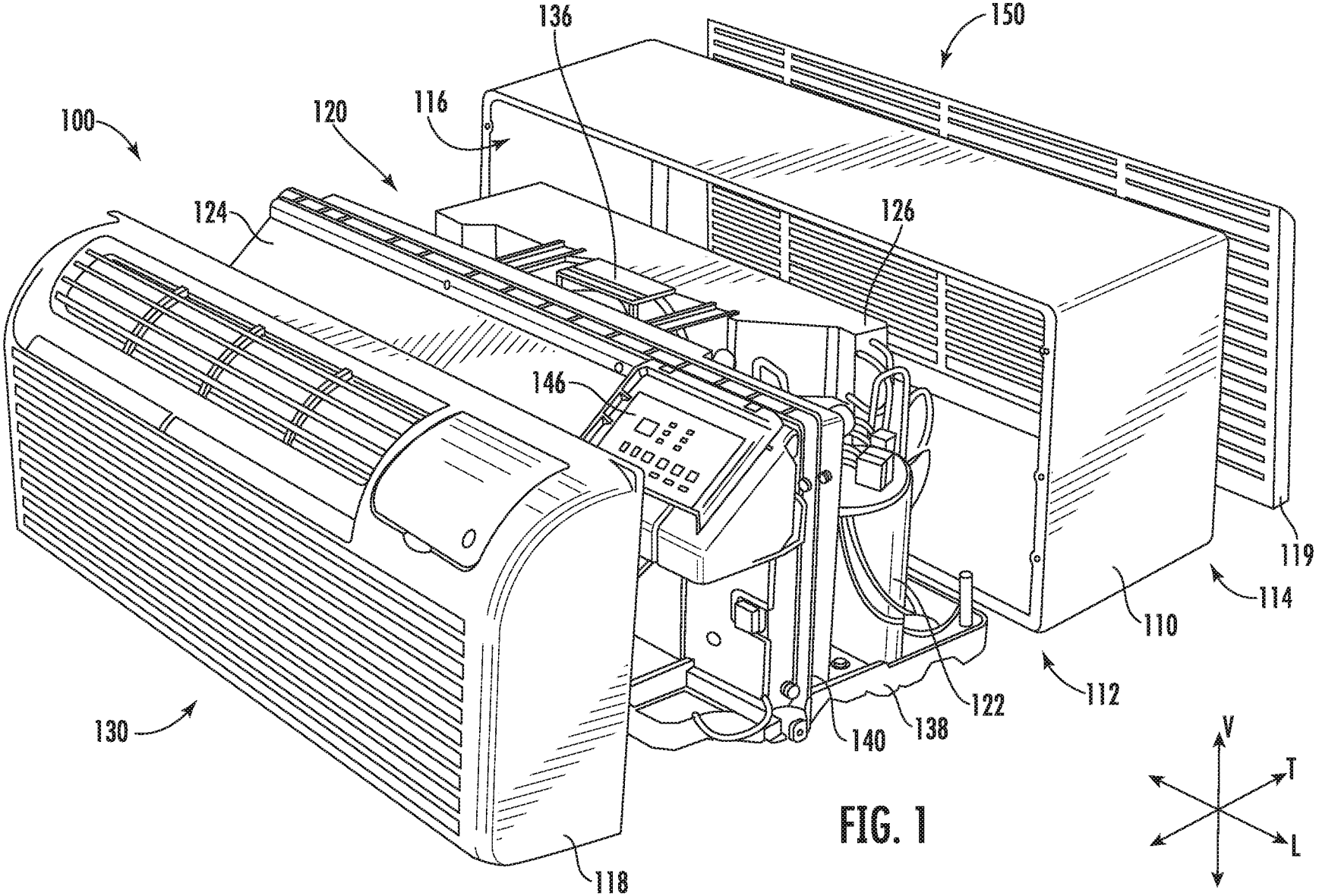
FIG. 1 provides an exploded perspective view of an exemplary air conditioner unit which may incorporate a bulkhead assembly in accordance with one or more embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Referring now to FIG. 1, an exemplary air conditioner unit 100 is illustrated. The air conditioner unit 100 is a one-unit type air conditioner, also conventionally referred to as a room air conditioner. The unit 100 includes an indoor portion 130 and an outdoor portion 150, and generally defines a vertical direction V, a lateral direction L, and a transverse direction T. The vertical direction V, the lateral direction L, and the transverse direction T are mutually perpendicular to each other, such that an orthogonal coordinate system is generally defined.

Air conditioner unit 100 is operable to generate chilled and/or heated air in order to regulate the temperature of an associated room or building. As may be seen in FIG. 1, air conditioner unit 100 includes a casing 110 extends between an interior side portion 112 and an exterior side portion 114. Interior side portion 112 of casing 110 and exterior side portion 114 of casing 110 are spaced apart from each other along the lateral direction L. Thus, interior side portion 112 of casing 110 may be positioned at or contiguous with an interior atmosphere, and exterior side portion 114 of casing 110 may be positioned at or contiguous with an exterior atmosphere. The air conditioner unit 100 also includes components for circulating air such as an outdoor fan 136 in the outdoor portion 150 and an indoor blower fan 134 (hereinafter, "indoor fan 134," such as may be seen in FIG. 2) in the indoor portion 130. Sealed system 120 includes components for transferring heat between the exterior atmosphere and the interior atmosphere. For example, sealed system 120 includes a compressor 122, an interior heat exchanger or coil 124 and an exterior heat exchanger or coil 126.

Casing 110 defines a mechanical compartment 116. Sealed system 120 is disposed or positioned within mechanical compartment 116 of casing 110. The sealed system 120 may be attached to the casing 110, e.g., with mechanical fasteners such as screws. A front panel 118 is attached to the sealed system 120, e.g., with a snap fit or interference fit, and a rear grill or screen 119 is mounted to casing 110. The front panel 118 and the rear grill 119 hinder or limit access to mechanical compartment 116 of casing 110. Front panel 118 is mounted to sealed system 120 such that the front panel 118 is positioned at interior side portion 112 of casing 110, and rear screen 119 is mounted to casing 110 at exterior side portion 114 of casing 110. Front panel 118 and rear screen 119 each define a plurality of holes that permit air to flow through front panel 118 and rear screen 119, with the holes sized for preventing foreign objects from passing through front panel 118 and rear screen 119 into mechanical compartment 116 of casing 110.

Air conditioner unit 100 also includes a drain pan or bottom tray 138 and a bulkhead assembly 140 positioned within mechanical compartment 116 of casing 110. Sealed system 120 is positioned on bottom tray 138. Thus, liquid runoff from sealed system 120 may flow into and collect within bottom tray 138. Bulkhead assembly 140 may be mounted to bottom tray 138 and extend upwardly from bottom tray 138 to a top wall of casing 110. Bulkhead assembly 140 limits or prevents air flow between interior side portion 112 of casing 110 and exterior side portion 114 of casing 110 within mechanical compartment 116 of casing 110. Thus, bulkhead assembly 140 may divide mechanical compartment 116 of casing 110.

Air conditioner unit 100 further includes a controller 146 with user inputs, such as buttons, switches and/or dials. Controller 146 regulates operation of the air conditioner unit 100. Thus, controller 146 is in operative communication with various components of air conditioner unit 100, such as components of sealed system 120 and/or a temperature sensor, such as a thermistor or thermocouple, for measuring the temperature of the interior atmosphere. In particular, controller 146 may selectively activate sealed system 120 in order to chill or heat air within sealed system 120, e.g., in response to temperature measurements from the temperature sensor.

Controller 146 includes memory and one or more processing devices such as microprocessors, CPUs or the like, such as general or special purpose microprocessors operable to execute programming instructions or micro-control code associated with operation of air conditioner unit 100. The memory can represent random access memory such as DRAM, or read only memory such as ROM or FLASH. The processor executes programming instructions stored in the memory. The memory can be a separate component from the processor or can be included onboard within the processor. Alternatively, controller 146 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 2:
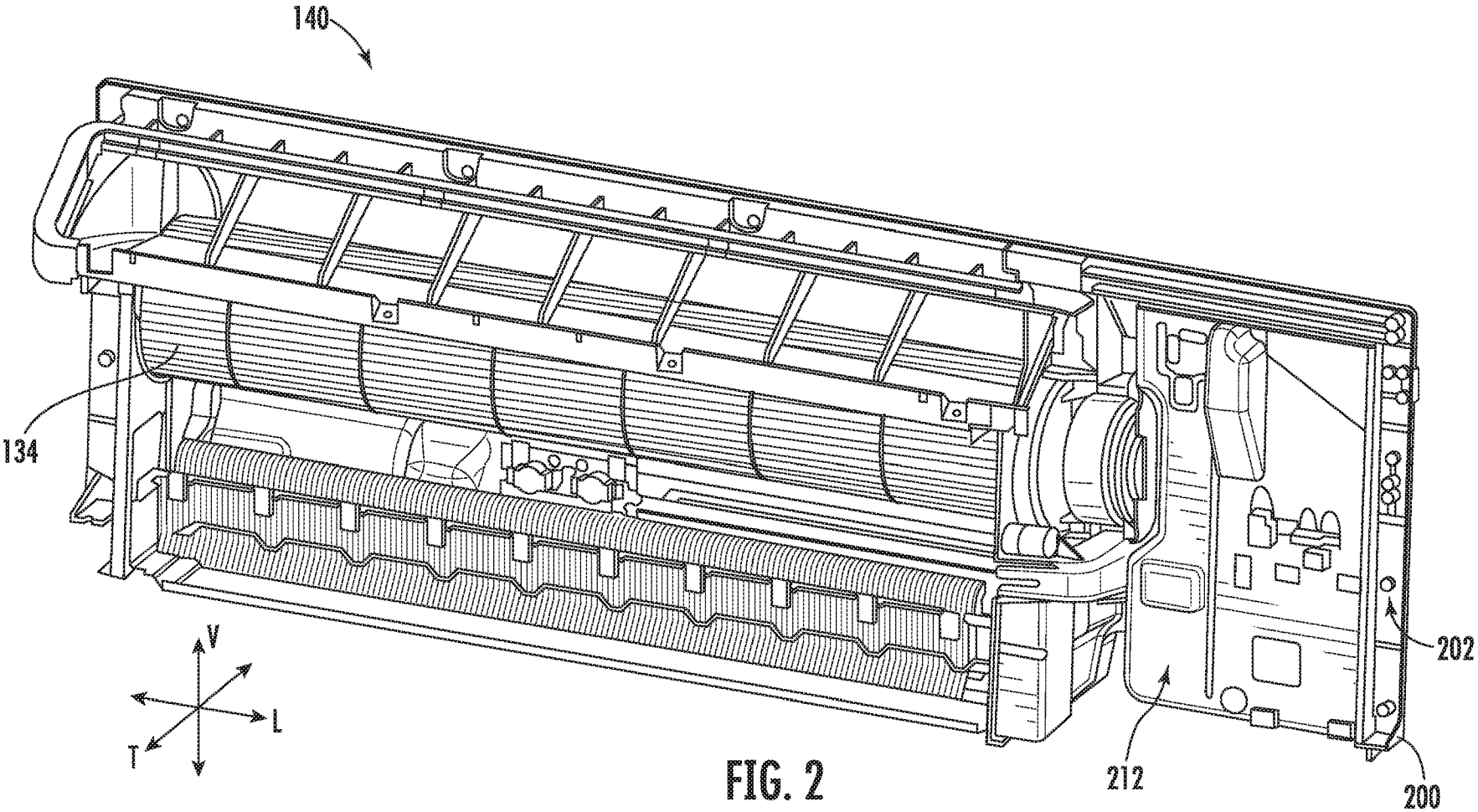
FIG. 2 is a perspective view of an indoor side of a bulkhead assembly in accordance with one or more embodiments of the present disclosure.
Figure 3:
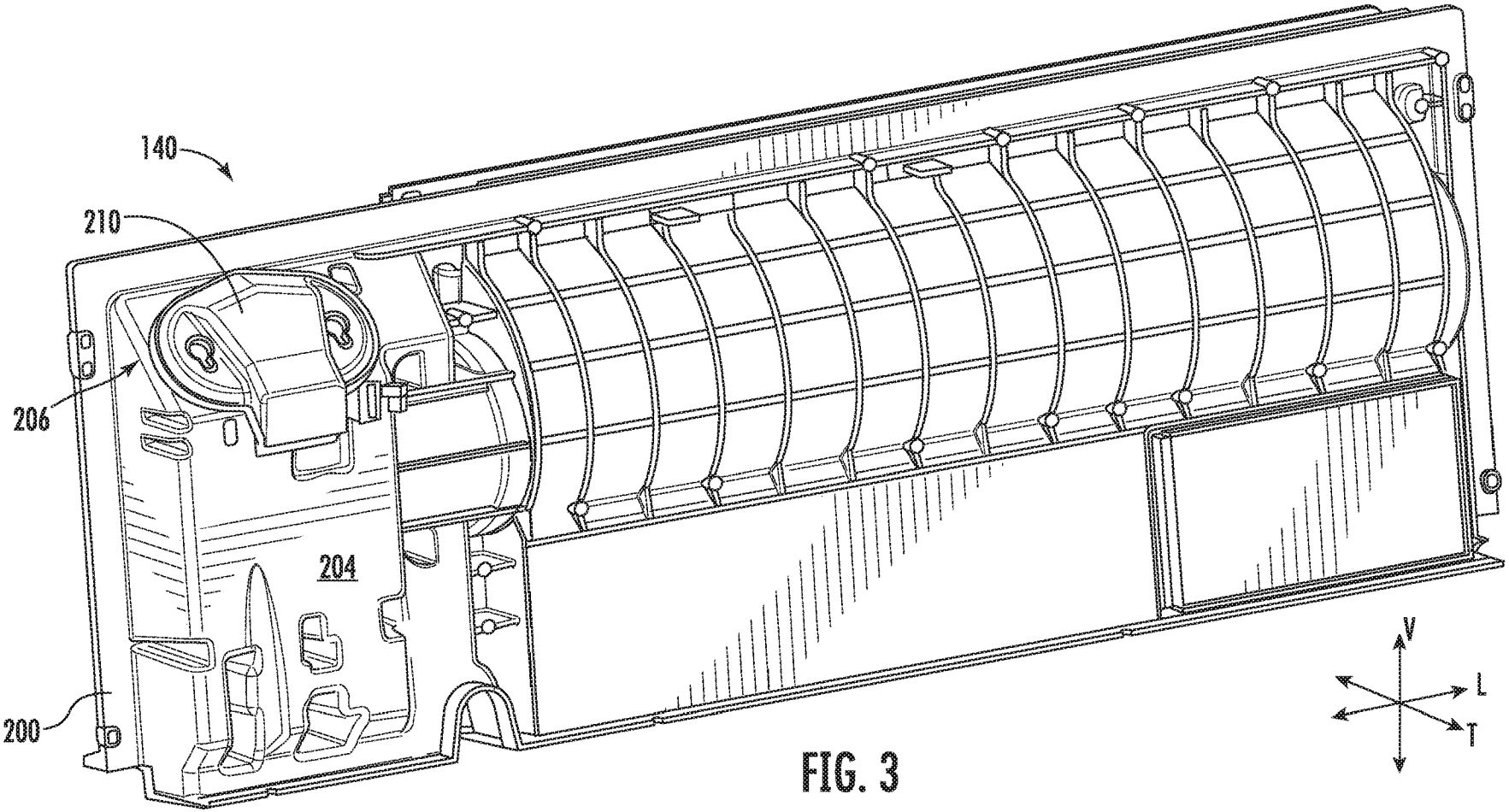
FIG. 3 is a perspective view of an outdoor side of the bulkhead assembly of FIG. 2.

Referring now to FIGS. 2 and 3, an exemplary bulkhead assembly 140 according to one or more embodiments of the present disclosure is illustrated. As shown, bulkhead assembly 140 includes a bulkhead 200. Bulkhead 200 generally defines a first surface facing a first direction and a second surface facing a second direction, the second surface opposite the first surface. FIG. 2 illustrates a perspective view of an indoor side of bulkhead assembly 140. As maybe seen in FIG. 2, bulkhead 200 includes an indoor surface 202 which faces the indoor portion 130 (FIG. 1) of the air conditioner unit 100. FIG. 3 illustrates a perspective view of an outdoor side of the bulkhead assembly 140. As may be seen in FIG. 3, bulkhead 200 includes an outdoor surface 204 which faces the outdoor portion 150 (FIG. 1) of the air conditioner unit 100. Thus, in at least some embodiments, the first surface of the bulkhead 200 may be the indoor surface 202, which faces in a first direction towards the indoor portion 130, and the second surface of the bulkhead 200 may be the outdoor surface 204 which faces in a second direction towards the outdoor portion 150. Where the bulkhead assembly 140, and in particular the bulkhead 200 thereof, are disposed between the indoor portion 130 and the outdoor portion 150, e.g., as illustrated in FIG. 1, the first direction and the second direction will be opposing one another. For example, the indoor surface 202 of the bulkhead 200 may face away from the outdoor surface 204 of the bulkhead 200.

As may be seen in FIG. 2, the bulkhead assembly 140 may include a cover 212 mounted to the indoor surface 202 of the bulkhead 200. As may be seen in FIG. 3, the outdoor surface 204 of the bulkhead 200 may include an oblique portion 206 which is oblique to the vertical direction V and a cover 210 may be removably attached to the oblique portion 206 of the outdoor surface 204 of the bulkhead 200. For example, the cover 210 may be removable attached to the oblique portion 206 with one or more mechanical fasteners, by a snap fit, and/or may be hingedly attached to the outdoor surface 204.

Figure 4:
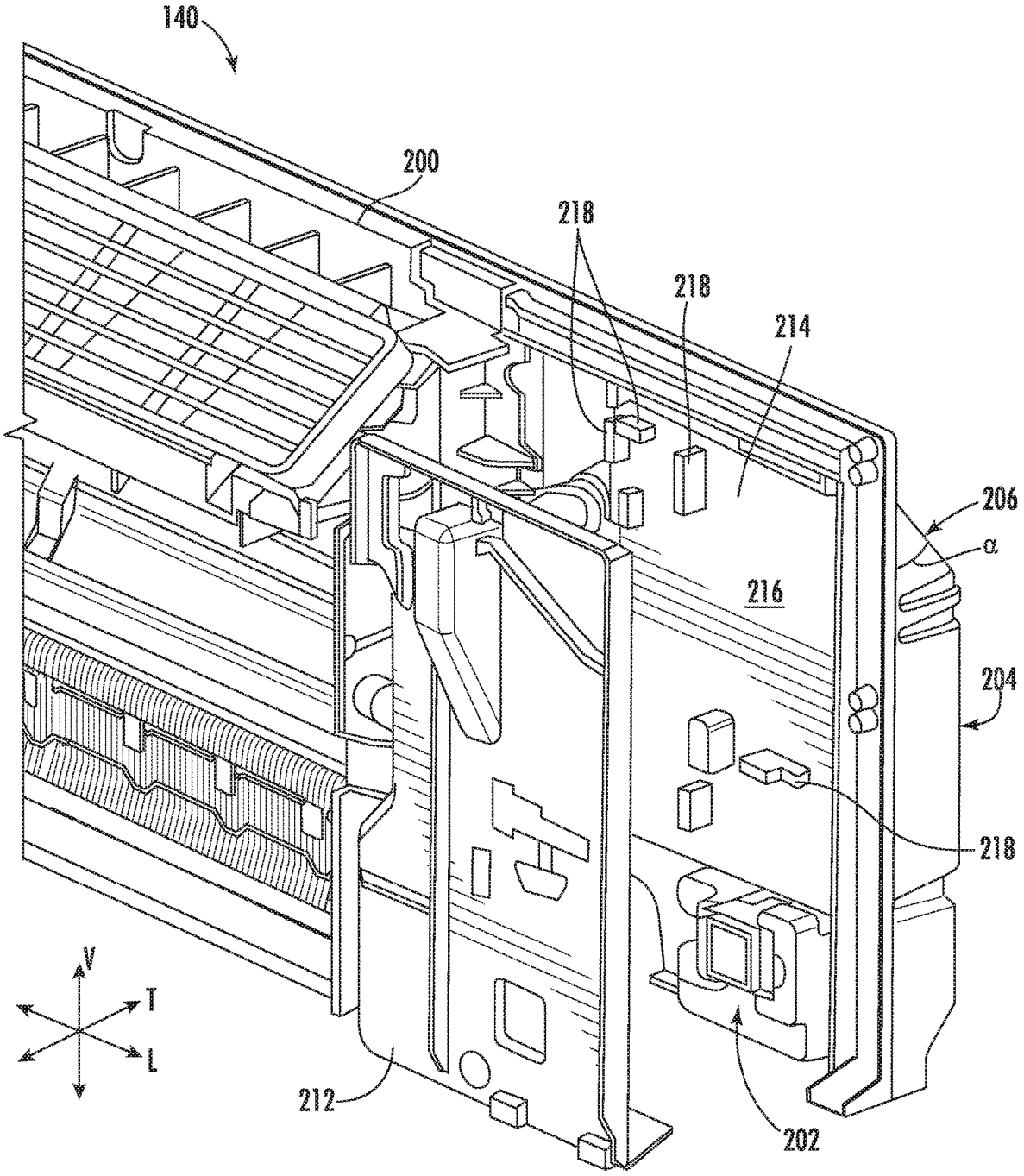
FIG. 4 is an enlarged view of a portion of FIG. 2.

FIG. 4 provides an enlarged and exploded view of a portion of FIG. 2. The bulkhead assembly 140 may generally include a first connector facing a first direction and a second connector facing a second direction opposite the first direction. As shown for example in FIG. 4, a printed circuit board 214 may be mounted to the indoor surface 202 of the bulkhead 200. The printed circuit board 214 may include an indoor surface 216 facing the indoor portion 130 (FIG. 1) of the air conditioner unit 100. At least one indoor connector 218 may be disposed on the bulkhead 200 and facing the indoor portion 130 of the air conditioner unit 100. For example, as illustrated in FIG. 4, the at least one indoor connector 218 may be one or more electrical connectors mounted on the indoor surface 216 of the printed circuit board 214. The at least one indoor connector 218 may include a plurality of indoor connectors 218 configured for connecting to a corresponding number of indoor components. Such indoor components may include, for example, one or more temperature sensors, e.g., thermistors, disposed in the indoor portion 130 of the air conditioner unit 100 and configured for measuring an indoor temperature, the indoor fan 134 and/or a motor thereof, and other similar components which may be disposed in the indoor portion 130, as will be understood by those of skill in the art. The structure and function of such components, e.g., temperature sensors, are well understood by those of skill in the art and, as such, are not described or shown in further detail herein for the sake of clarity and concision. In at least some embodiments, the first connector mentioned above may be the indoor connector 218, or one of a plurality of indoor connectors 218, e.g., as illustrated in FIG. 4, where the first direction which the first connector faces is towards the indoor portion 130.

As best seen in FIG. 4, the cover 212 may be mounted to the indoor surface 202 of the bulkhead 200 over the printed circuit board 214 such that the cover 212 is disposed between the printed circuit board 214 and the indoor portion 130 (FIG. 1) of the air conditioner unit 100.

Figure 5:
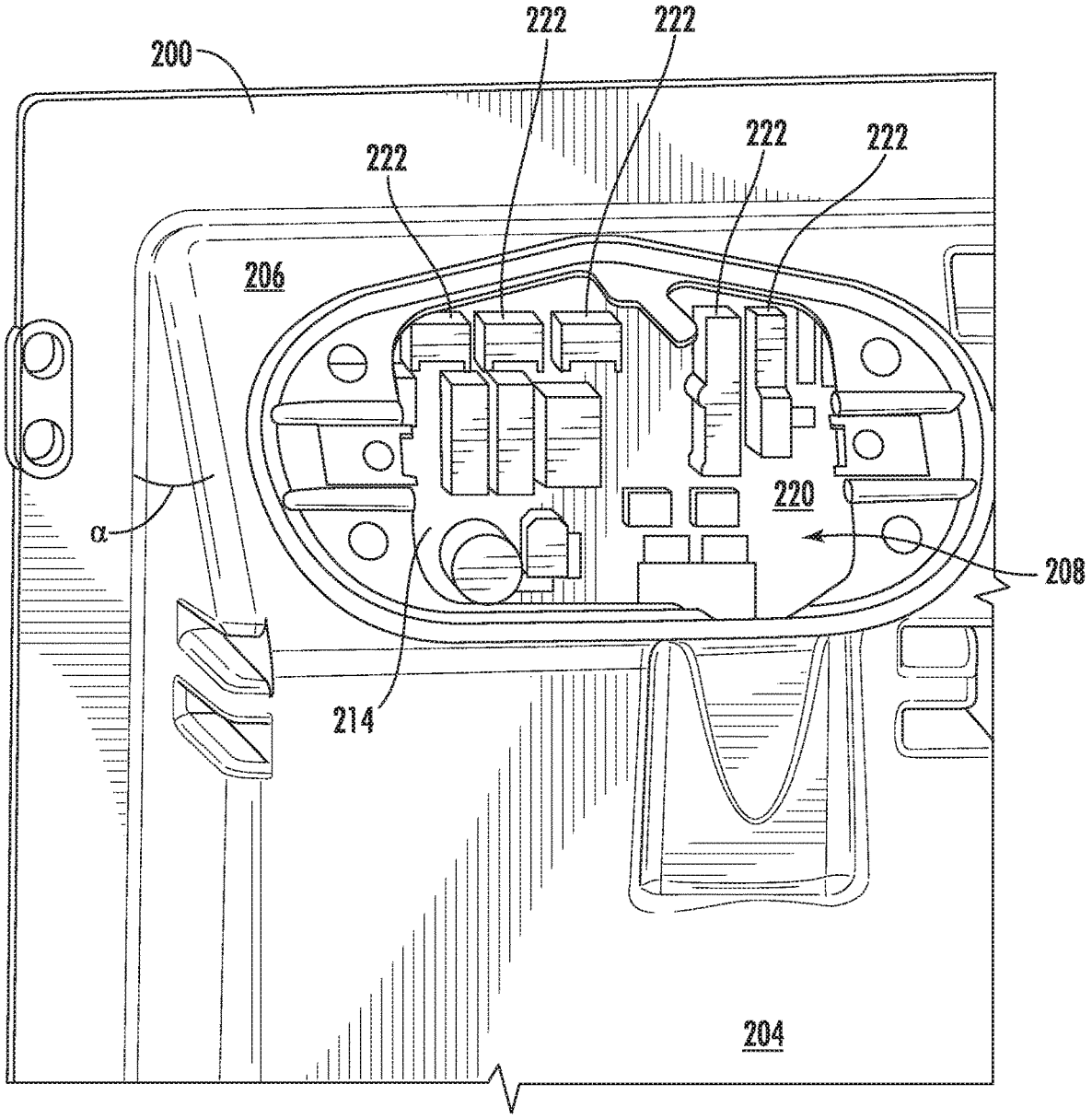
FIG. 5 is an enlarged view of a portion of FIG. 3.

FIG. 5 illustrates an enlarged view of a portion of FIG. 3, with the cover 210 removed to reveal an opening 208. Also, the printed circuit board 214, in particular an outdoor surface 220 thereof, may be seen through the opening 208. At least one outdoor connector 222 may be disposed on the bulkhead 200 and facing the outdoor portion 150 of the air conditioner unit 100. For example, as illustrated in FIG. 5, the at least one outdoor connector 222 may be one or more electrical connectors mounted on the outdoor surface 220 of the printed circuit board 214. The at least one outdoor connector 222 may include a plurality of outdoor connectors 222 configured for connecting to a corresponding number of outdoor components. Such outdoor components may include, for example, the outdoor fan 136, one or more temperature sensors, e.g., thermistors, similar to the exemplary indoor temperature sensors described above, and/or one or more valves and associated actuators. For example, the outdoor components may include an internal condensation recirculation valve, a makeup air module, as well as various other suitable outdoor components, as will be understood by those of skill in the art. The structure and function of such components, e.g., valves and/or makeup air modules, are well understood by those of skill in the art and, as such, are not described or shown in further detail herein for the sake of clarity and concision. In at least some embodiments, the second connector mentioned above may be the outdoor connector 222, or one of a plurality of outdoor connectors 222, e.g., as illustrated in FIG. 5, where the second direction which the second connector faces is towards the outdoor portion 150.

As best seen in FIG. 5, the opening 208 may be aligned with the at least one outdoor connector 222, such that the opening 208 is configured to permit access to the at least one outdoor connector 222 from the outdoor portion 150 of the air conditioner unit 100. As generally shown throughout FIGS. 3-5, the outdoor surface 204 of the bulkhead 200 may include an oblique portion 206 which extends at an oblique angle $\alpha$ to the vertical direction V and the opening 208 may be defined in the oblique portion 206. Thus, as shown, the oblique portion 206 of the outdoor surface 204 is also oblique to the indoor surface 202 of the bulkhead 200. For example, the indoor surface 202 may be generally or predominantly oriented within a vertical-lateral plane defined by the vertical direction V and the lateral direction L, such that the oblique portion 206 of the outdoor surface 204 is oblique to the indoor surface 202, e.g., when viewed from the side, such as looking along the lateral direction L, and/or within a vertical-transverse plane. The oblique portion 206 may advantageously provide access to the at least one outdoor connectors 222, e.g., via the opening 208 as mentioned, while also accommodating additional components within the bulkhead assembly 140, e.g., tubing connected to the sealed system 120, such as copper tubing. The oblique portion 206 may be close to vertical. As mentioned, the oblique portion 206 may be disposed at an angle $\alpha$ with the vertical direction. For example, the angle $\alpha$ may be less than about fifty degrees, such as less than about forty-five degrees, such as less than about thirty-five degrees, such as about thirty degrees or less.

The air conditioner unit of the present disclosure provides several advantages. For example, providing the outdoor connectors on an outdoor-facing surface reduces the time and expense needed to assemble and/or disassemble the unit, such as during manufacture or maintenance, etc. Also by way of example, the opening in the outdoor surface of the bulkhead advantageously provides access to the outdoor connectors from the outdoor portion of the air conditioner unit, promoting ease of assembly and reducing the amount of materials, e.g., length of copper wires, needed to make up the connections during assembly and/or maintenance of the air conditioner unit.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit defining a vertical direction, a lateral direction, and a transverse direction, the vertical direction, the lateral direction, and the transverse directions are mutually perpendicular, the air conditioner unit comprising:

at least one outdoor component disposed in an outdoor portion of the air conditioner unit;

at least one indoor component disposed in an indoor portion of the air conditioner unit;

a bulkhead disposed between the outdoor portion and the indoor portion along the transverse direction, the bulkhead comprising an indoor surface facing the indoor portion of the air conditioner unit and an outdoor surface facing the outdoor portion of the air conditioner unit;

at least one indoor connector disposed on the bulkhead and facing the indoor portion of the air conditioner unit;

at least one outdoor connector disposed on the bulkhead and facing the outdoor portion of the air conditioner unit;

a printed circuit board mounted to the indoor surface of the bulkhead, wherein the at least one indoor connector is an electrical connector disposed on an indoor surface of the printed circuit board, and wherein the at least one outdoor connector is an electrical connector disposed on an outdoor surface of the printed circuit board, wherein the outdoor surface of the bulkhead includes an opening aligned with the at least one outdoor connector, the opening configured to permit access to the at least one outdoor connector from the outdoor portion of the air conditioner unit; and an oblique portion of the outdoor surface of the bulkhead, wherein the oblique portion is oblique to the vertical direction, and the opening is defined in the oblique portion of the outdoor surface of the bulkhead.

2. The air conditioner unit of claim 1, further comprising a cover mounted to the indoor surface of the bulkhead over the printed circuit board whereby the cover is disposed between the printed circuit board and the indoor portion of the air conditioner unit.

3. The air conditioner unit of claim 1, wherein the oblique portion of the outdoor surface of the bulkhead is disposed at an angle less than forty-five degrees with the vertical direction.

4. The air conditioner unit of claim 1, wherein the at least one indoor component includes an indoor fan, the at least one indoor connector includes an indoor fan connector, and the indoor fan is connected to the indoor fan connector.

5. The air conditioner unit of claim 1, wherein the at least one outdoor component includes an outdoor fan, the at least one outdoor connector includes an outdoor fan connector, and the outdoor fan is connected to the outdoor fan connector.

6. A bulkhead assembly disposed between an indoor portion of an air conditioner unit and an outdoor portion of the air conditioner unit, the bulkhead assembly comprising:

a bulkhead, the bulkhead comprising a first surface facing a first direction and a second surface facing a second direction, the second surface opposite the first surface;

a first connector disposed on the bulkhead and facing the first direction; and a second connector disposed on the bulkhead and facing the second direction;

a printed circuit board mounted to the first surface of the bulkhead, wherein the first connector is an electrical connector disposed on a first surface of the printed circuit board, and wherein the second connector is an electrical connector disposed on a second surface of the printed circuit board opposite the first surface of the printed circuit board, wherein the second surface of the bulkhead includes an opening aligned with the second connector, the opening configured to permit access to the second connector; and an oblique portion of the second surface of the bulkhead, wherein the oblique portion is oblique to the first surface of the bulkhead, and the opening is defined in the oblique portion of the second surface of the bulkhead.

7. The bulkhead assembly of claim 6, further comprising a cover mounted to the first surface of the bulkhead over the printed circuit board.

8. The bulkhead assembly of claim 6, wherein the oblique portion of the second surface of the bulkhead is disposed at an angle less than forty-five degrees with the first surface of the bulkhead.

9. The bulkhead assembly of claim 6, wherein the first connector is configured to connect to an indoor fan of the air conditioner unit.

10. The bulkhead assembly of claim 6, wherein the second connector is configured to connect to an outdoor fan of the air conditioner unit.

* * * * *